United States Patent [19]

Becker et al.

[11] Patent Number: 4,635,936

[45] Date of Patent: Jan. 13, 1987

[54] INFLATABLE RACKET

[75] Inventors: James R. Becker, New York, N.Y.; Peter Wehn, Garbsen, Fed. Rep. of Germany; Peter Rademacher, Hemmingen, Fed. Rep. of Germany

[73] Assignee: Anjar Co., New York, N.Y.

[21] Appl. No.: 533,991

[22] Filed: Sep. 20, 1983

[30] Foreign Application Priority Data

Sep. 24, 1982 [DE] Fed. Rep. of Germany ..... 3235897

[51] Int. Cl.[4] ..... A63B 59/00

[52] U.S. Cl. ..... 273/67 R; 273/73 J

[58] Field of Search ..... 273/26 B, 67 B, 73 R, 273/67 R, 29 R, 30, 1 R, 1 B, 1 C, 73 E, 73 L, 76, 72 R, 73 C, 29 A; 46/87, 90; 5/480, 481, 449; 441/40, 41; D21/237, 238, 210–214; 446/220–226

[56] References Cited

U.S. PATENT DOCUMENTS

| | | | |
|---|---|---|---|
| 360,468 | 4/1887 | Phelps | 273/73 E |
| 1,558,507 | 10/1925 | Ryder | 273/73 E |
| 2,987,317 | 6/1961 | Acevedo | 273/67 |
| 3,162,443 | 12/1964 | Petri | 273/73 R |
| 3,802,009 | 4/1974 | Clemente | 273/67 B |
| 4,080,751 | 3/1978 | Copstead | 46/1 R |
| 4,357,012 | 11/1982 | Maynard | 273/73 L |

FOREIGN PATENT DOCUMENTS

| | | | |
|---|---|---|---|
| 203921 | 6/1959 | Austria | 273/73 R |
| 507329 | 12/1951 | Belgium | 273/67 R |
| 2222005 | 5/1972 | Fed. Rep. of Germany . | |
| 1133204 | 11/1956 | France | 273/76 |
| 1573987 | 3/1968 | France . | |
| 461689 | 5/1935 | United Kingdom | 46/87 |
| 834280 | 10/1956 | United Kingdom . | |

*Primary Examiner*—Richard C. Pinkham
*Assistant Examiner*—Matthew L. Schneider
*Attorney, Agent, or Firm*—Ladas & Parry

[57] ABSTRACT

A racket for playing ball games especially with foam balls. An ankh (without the cross) shaped inner inflatable portion is covered by an outer racket shaped envelope. The toroidal portion of the ankh stretches the outer envelope to develop a rigid racket. The outer, stretched, envelope's surfaces are used as the ball striking surfaces. A squeezable pump located in the handle is used for inflating the racket. A manually operated valve located in the handle is used to deflate the racket for convenient storage.

18 Claims, 16 Drawing Figures

INFLATABLE RACKET

TECHNICAL FIELD

The present invention relates to a gaming or play device and, more particularly, relates to a self-inflatable racket used in games such as: paddle ball; racket ball; platform tennis; tennis; table tennis; and any other game utilizing a racket and ball. The racket is preferably formed of heat sealed plastic sheet such as vinyl. The balls used with the racket are preferably soft, for example, foam plastic balls.

BACKGROUND ART

Almost as a rule, rackets for playing ball games comprise a frame with a handle and a head with strings. Still other rackets are flat and made of solid material. All conventional rackets have the disadvantage of being dimensionally stable, requiring much space when either stored or carried in bags for travel. The present invention overcomes the aforementioned disadvantages inherent in known rackets while fulfilling all of the requirements of a racket. The present invention overcomes the disadvantages in conventional rackets by providing a racket comprised, in part, of an inflatable element. Such a racket requires little space for storage or transport but, nevertheless, performs like conventional rackets while in use. Thus it is possible to reduce the volume of a racket by deflating it in such a way to make it possible to fold up and store the racket easily into luggage, a handbag, or other relatively small compartments. It is then possible, according to the present invention, to quickly and simply inflate the racket for use. While inflatable game devices are known, such as U.S. Pat. No. 2,987,317; U.S. Pat. No. 4,080,751; United Kingdom Pat. No. 834,280; West German Pat. No. 2,222,005; and French Pat. No. 1,573,986; all have the disadvantage of requiring a separate pumping device for inflation. By providing a racket that has a self-contained pump, the present invention overcomes the inherent disadvantage of the prior art of requiring a separate pump and needle. The outer envelope of the present device stretched across the opening in the toroidal shaped inflatable portion forms a rigid construction, overcoming the inherent limpness of the prior art inflatables.

SUMMARY OF THE INVENTION

The invention relates to an inflatable racket for playing ball games. The racket comprises an inflatable element that forms the inner portion or skeleton of the racket. The invention is further characterized by the inflatable element being contained within an "envelope" which gives shape and structural rigidity to the racket. The racket has a pump handle, which is squeezed to cause the racket to inflate to a prescribed amount. A manually operated deflation valve is also located on the handle. Excess pressure may be let off through an overpressure valve located on the racket, although this may not be required in all instances.

DISCLOSURE OF THE INVENTION

The racket comprises an "envelope" giving shape to the racket, in which an inflatable element is fitted. In one embodiment, an extraordinarily rigid racket can be achieved if the inflatable element is toroidal shaped and stretches the envelope taut across the hole in the toroid. In this embodiment the envelope must not be airtight.

This results in the outer surfaces of the envelope remaining parallel when inflated. The outer surfaces do not bulge or cause other irregularities in the shape of the ball striking surfaces of the racket and the surface away from a struck surface tensions and resists deformation of the struck surface.

Alternatively, the interior of the inflatable element may be filled with open-cell foam or corrugated sheet.

The inflatable element and the envelope can be sealed together at their peripheries by bonding, heat sealing, or chemical reaction.

It is advisable to form halves symmetrical to the center plane of the racket, including the handle which, after fitting of the inflatable element, are connected at the edge by heat sealing or bonding. The envelope may also be constructed of one piece by means of blow-molding, deep-drawing, or injection molding.

An air inlet is fitted to the bottom end of the handle. The inlet may be fitted with a butterfly valve with a weakened tube, opening by deformation when reaching a prescribed pressure and thereby letting off overpressure.

Aiding the user in their grip of the handle, a glove or mitten may be attached, by adhesive material for example, to the handle. The glove also acts to protect the users hands from contact with the playing ball.

Finally, the invention may incorporate a pump fitted in the handle of the racket. This enables the user to obtain the necessary air pressure in the racket without the use of any further device.

OBJECTS OF THE INVENTION

It is, therefore, an object of the present invention to provide an inflatable device having a striking surface that may be conveniently inflated during use and deflated when not in use without the use of external pumps and adapters.

It is another object of the present invention to provide a portable tennis racket, or similar gaming device, that stores easily for travel.

It is an additional object of the present invention to provide a very rigid inflatable device having a striking surface.

It is an additional object of the present invention to provide a self-contained pump in a portable racket that is convenient to use and does not adversely affect the usefulness of the racket.

It is still another object of the present invention to provide a portable racket that may be inflated for use, perform substantially like conventional rackets, yet may be deflated when not in use.

The invention accordingly comprises an article of manufacture possessing the features, properties, and the relation of elements which will be exemplified in the articles hereinafter described. The scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

The same reference numbers refer to the same elements throughout the several views of the drawings.

BEST MODE FOR CARRYING OUT THE INVENTION

The dimensions of the racket according to the invention can be altered as required but may be, for example:

Width A of the handle: 4 cm

Length B of the racket: 40 cm

Thickness C of the handle: 4 cm

Thickness C1 at the top of the racket: 1 cm

Figure 1A:
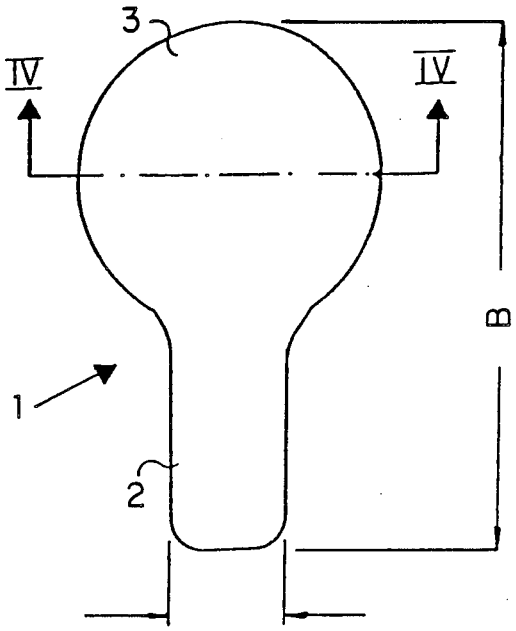
FIG. 1*a* is a top view of a racket according to the invention.
Figure 1B:
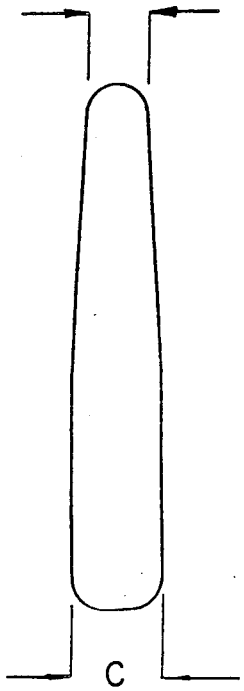
FIG. 1*b* is a side view of the racket of FIG. 1*a;*
Figure 2:
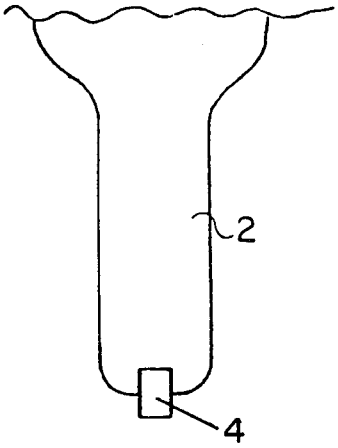
FIG. 2 is a view of the handle of the racket of FIG. 1*a* showing the air inlet thereof.

Referring to FIG. 1, the racket 1 contains an inflatable element, described later, which is connected to an air inlet 4 according to FIG. 2 which is fitted to the end of the handle 2 and by which the racket is inflated by mouth or by a pump. A valve 18 (FIG. 5) is attached at the end of the inlet 4 to avoid deflation.

Figure 3:
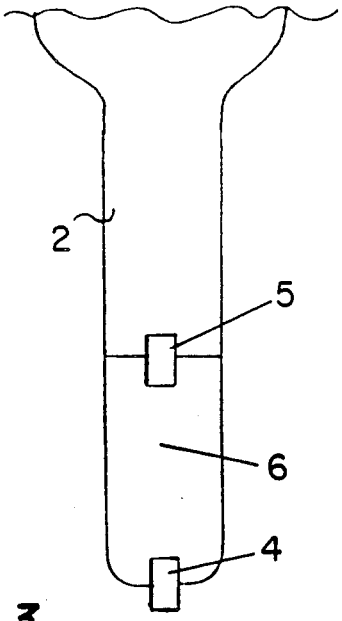
FIG. 3 is a view of the handle of the racket of FIG. 1*a* showing the pump in between the valves thereof.

FIG. 3 shows a possible design with a pump fitted into the handle 2 between the inlet valve and a further valve 5. By pressing the handle in the area between the valves 5 and 18 air can be pumped into the inflatable element.

Figure 4C:
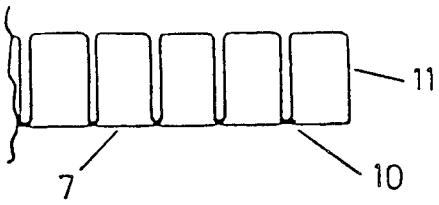
FIGS. 4*a* through 4*e* are cross sectional views taken along the line IV—IV of FIG. 1*a* of alternative embodiments.
Figure 4B:
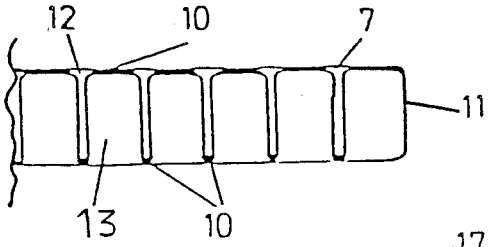
Figure 4E:
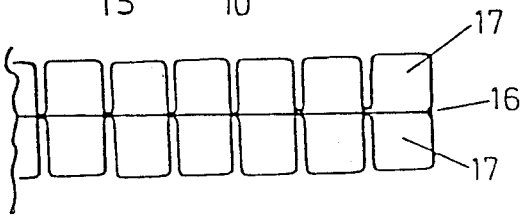
Figure 4A:
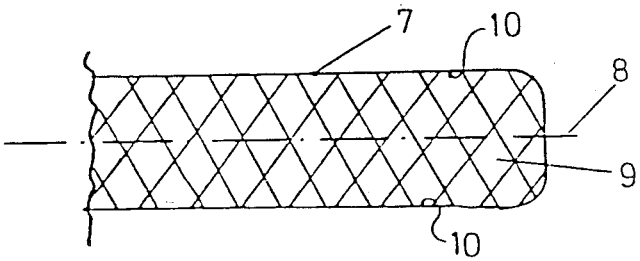

According to FIG. 4*a* the inflatable element 9 consists of open-cell foam which fills completely an envelope 7 made of an airtight thermoplastic polyurethane foam. The outer surface of the foam is attached to the inner surface of the envelope 7 with the effect that by blowing air into the foam element 9 a pressurized body is formed which does not bulge so that the two outer surfaces of the head of the racket remain parallel to each other.

An alternative to having an inflatable body of open-cell foam, a structure according to FIG. 4*b* made of a thin sheet 11 can be used consisting of square waves where narrow wave troughs 12 are followed by broader wave crests 13 and where wave troughs 12 and wave crests 13 are attached at areas 10 to the envelope 7 to guarantee the necessary parallelism of the ball striking surfaces and the desired rigidity.

The attachments between the inflatable element 9 and the envelope 7 may be achieved by bonding. However, attachment is also possible by heat, especially by heat sealing. In lieu of that, attachment between inflatable element 9 and envelope 7 can also be achieved by chemical reaction.

The envelope 7 preferably consists of two halves including the handle, symmetrical to the center plane 8 of the racket 1 which are attached together at their edges by means of heat sealing or bonding.

It is also possible to manufacture the envelope in one piece by blow-molding, deep-drawing, injection molding or similar means and then to expand the open-cell polyurethane foam in it.

In one change of design, according to FIG. 4*b*, a thin sheet 11 alone can be attached to a carrier sheet 7. However, in this embodiment the rigidity of the racket is less.

Figure 4D:
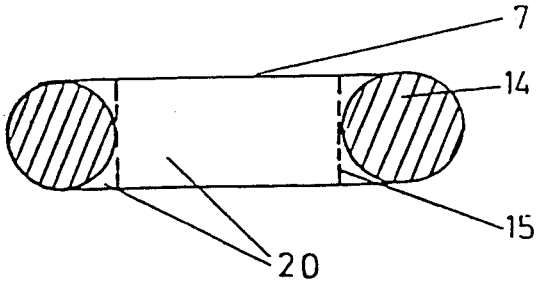

In an alternative embodiment, a ring 14 forms the inflatable element, according to FIG. 4*d*, and the contour of the racket which is wrapped in an outer envelope 7. Here the area under pressure is restricted to the ring 14 so that the inner areas 20 of the envelope are only under atmospheric pressure and, therefore must not consist of airtight material. Ribs 15 may be provided in between the surfaces of the envelope 7 to increase the rigidity of the head of the racket.

According to FIG. 4*e* the inflatable element can also be designed to be self-supporting. With this type a thin sheet 16, fitted in center plane of the racket is attached to rectangular tubes 17 on both sides fitted narrowly side by side, all leading to the handle and being interconnected with the air inlet 4 (FIGS. 2 and 3).

Figure 5:
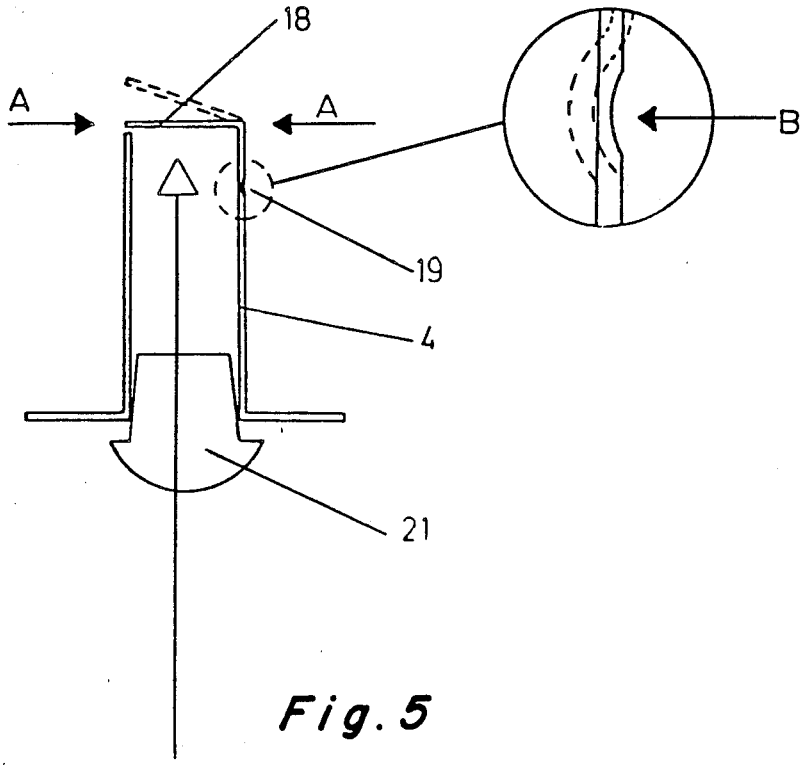
FIG. 5 is an enlarged view showing a design of an air inlet.

FIG. 5 shows the design of an air inlet 4 where at the end of the inlet a butterfly valve 18 is fitted, opening when inflated and closed by the pressure obtained in the inflatable element 9.

To prevent damage to the racket due to excessive pressure when filling it with air, a weakened area 19 in the vicinity of the butterfly valve 18 is provided which is deformed in direction B into the interior of the inlet, thus automatically opening the butterfly valve and making possible a reduction of air pressure. Various other forms of pressure relief valves may be provided.

After pressurizing the racket the inlet 4 can be closed with a plug. By pressing, e.g. with fingers, in direction A—A, air escapes from the inflatable element so that the racket can be folded compactly for transport or storage.

A preferred embodiment of a racket 25 according to the invention is shown in FIGS. 6 through 10*b*.

The dimensions of racket 25 may be widely varied and are governed only by the requirements of the particular game in which the player is engaged. Certain dimensions, when deflated, of this embodiment are as follows:

Width of the handle: 6.99 cm

Length of the racket: 44.45 cm

Diameter of the pump: 4.06 cm

Figure 7:
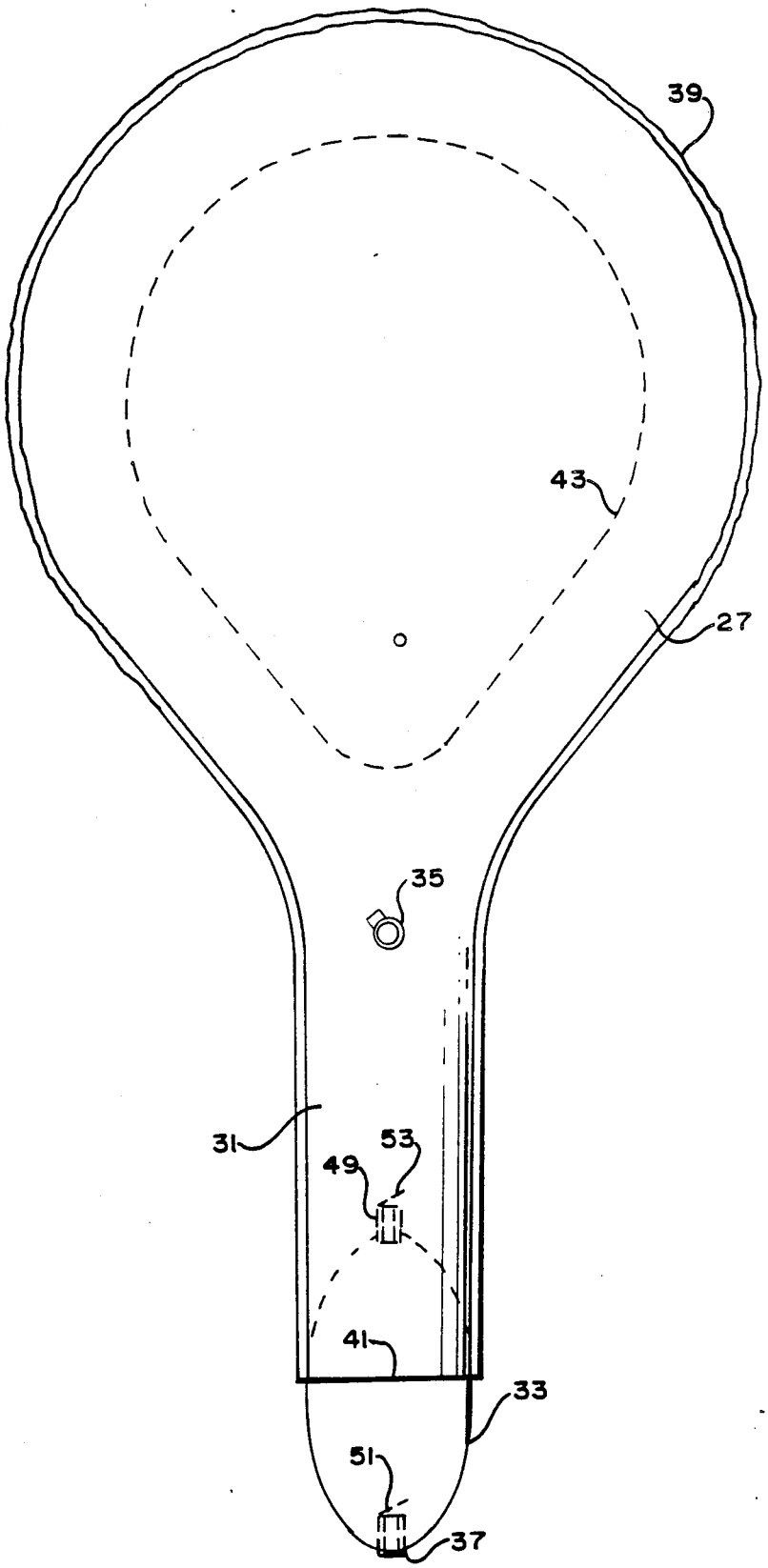
FIG. 7 is a front view of the racket of FIG. 6.
Figure 8:
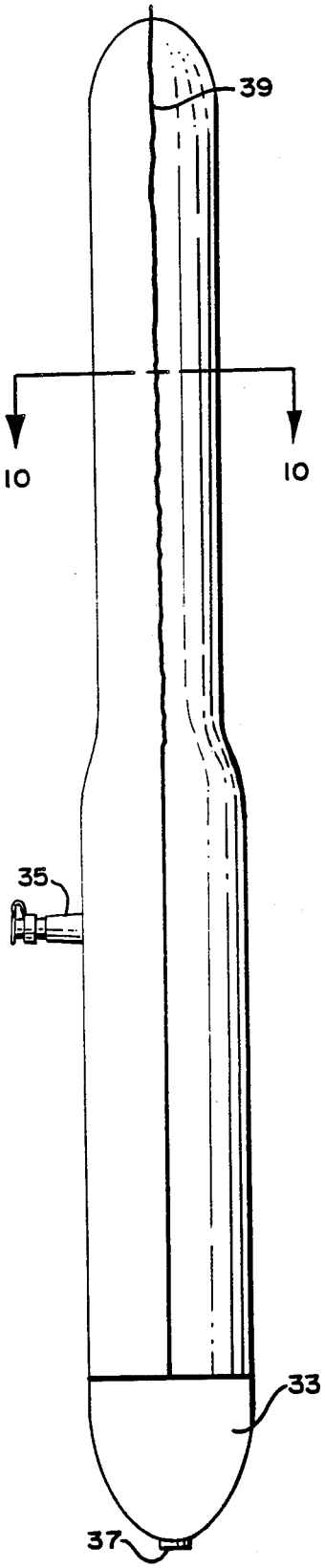
FIG. 8 is a side view of the racket of FIG. 6.
Figure 9:
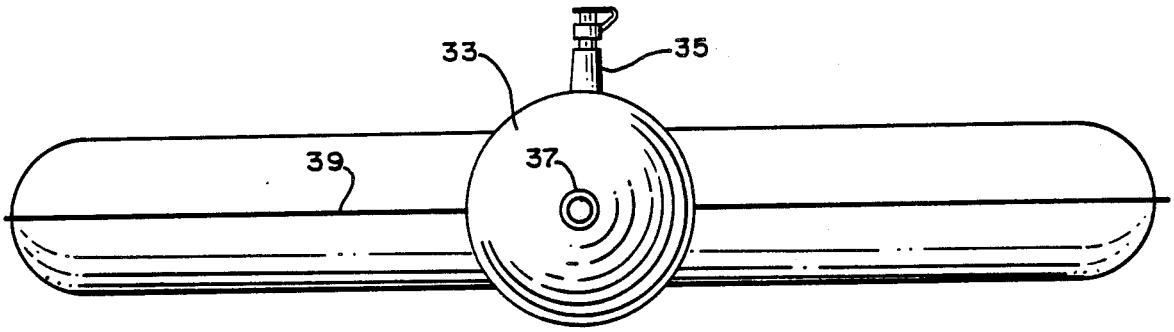
FIG. 9 is a bottom end view of the racket of FIG. 6.
Figure 10A:
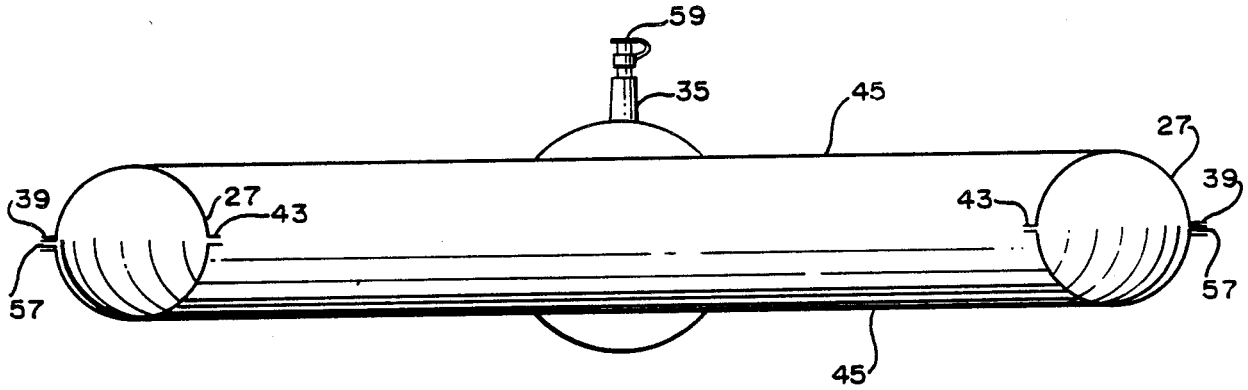
FIG. 10*a* is a diagrammatic cross sectional view taken along line 10—10 of FIG. 8 showing the racket of FIG. 6 inflated.

The racket 25 comprises an ankh shaped without the horizontal cross member single chamber inflatable element 27 (see FIGS. 7 and 10*a*). The inflatable element 27 is fitted inside racket shaped outer envelope 29. The stem of the ankh shaped element 27 forms the handle 31.

Both the inner inflatable element 27 and the outer envelope 29 are formed of heat sealable vinyl sheet.

Again referring to FIG. 6, the handle 31 of the racket 25 is provided with a squeeze pump 33 similar to that utilized to pump up the pressure cuffs used for measuring blood pressure. The handle 31 is also provided with a deflation valve 35 similar to the valve provided in inflatable air mattresses, for deflating the racket 25.

When the pump 33 is squeezed, air is pumped from within it into the handle 31. When the pump 33 expands, air enters through air inlet 37 into the pump 33 ready for the next squeeze to further inflate the racket.

Figure 10B:
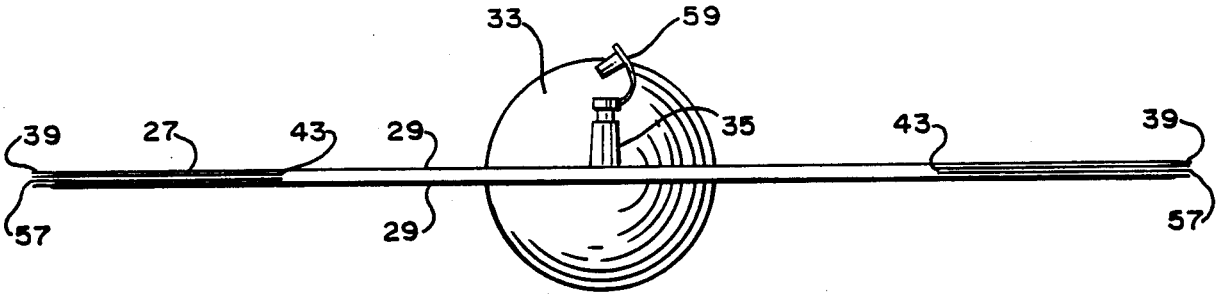
FIG. 10*b* is a diagrammatic cross sectional view taken along line 10—10 of FIG. 8 showing the racket of FIG. 6 deflated.

The racket is formed of four sheets of material (see also FIG. 10*b*). All four sheets are sealed together along peripheral seal 39 and are sealed to the body of the pump 33 and together along seal 41. The seal 41 may be formed by heat sealing, chemical reaction or adhesive, as may the peripheral seal 39. However, heat sealing is the preferred mode of manufacture.

Now referring to FIG. 7, the inner inflatable element 27 is sealed along an inner circumferential seal 43 to form a generally toroidal shaped portion with the depending handle portion 31.

Figure 6:
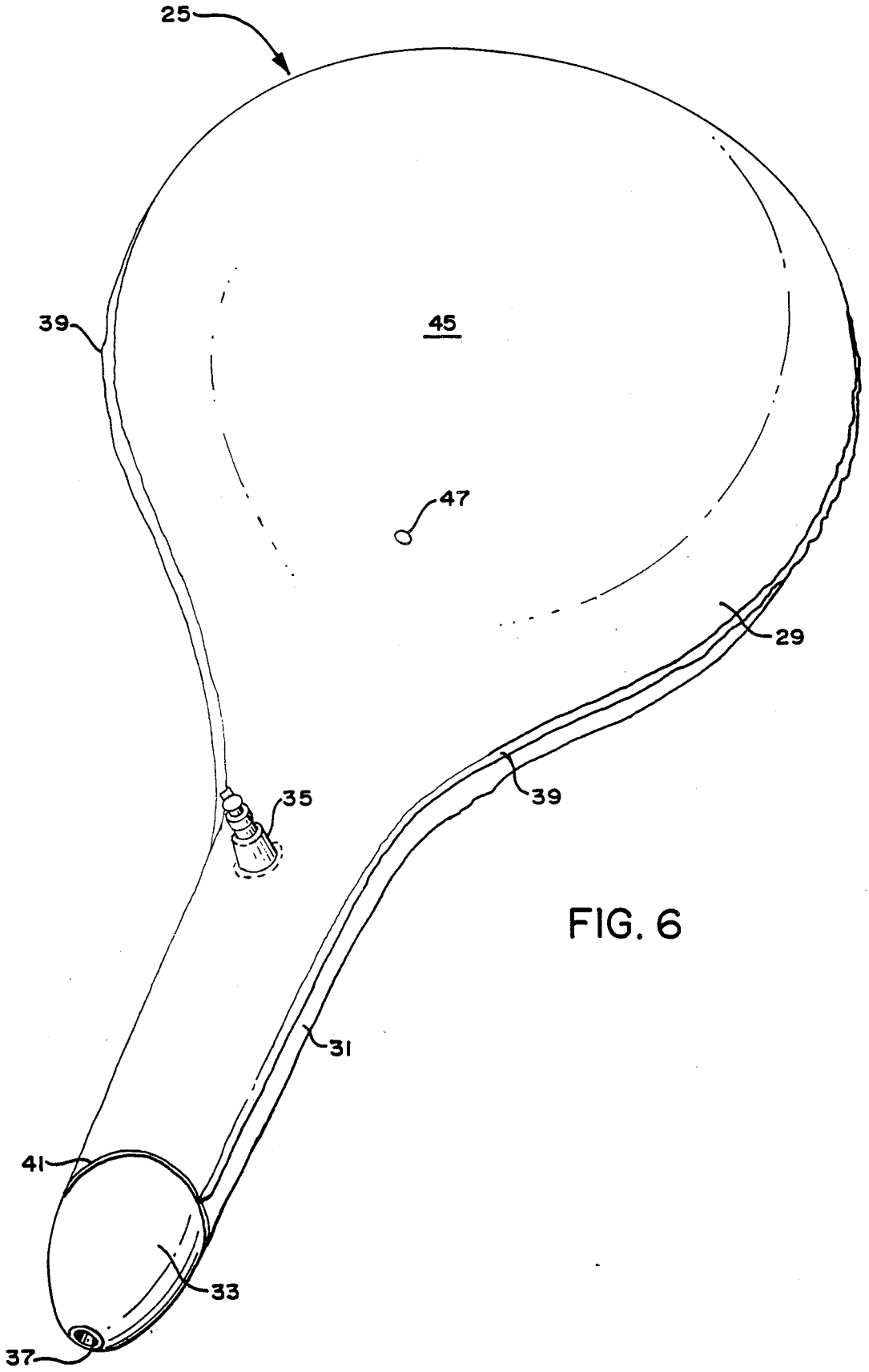
FIG. 6 is a perspective view of an inflated, preferred form of racket according to the invention.

As seen in FIGS. 6 and 7, one or more of the striking surfaces 45 are provided with a hole 47 so that air may be freely admitted or expelled from the region between the striking surfaces 45 and encompassing the hole in the toroid.

As seen in FIG. 7, the pump 33 is provided with an inlet 37 and an outlet 49 and these in turn are provided with valves 51 and 53, respectively. These may be the flapper valves shown, or may be ball valves, or any other suitable valve.

The way in which the racket is formed can best be understood with reference to FIGS. 10*a* and 10*b*. Two inner sheets of vinyl are cut into the ankh shape and sealed along their inner and outer peripheries 43 and 57. Then, two further sheets of vinyl cut into racket shapes forming the outer envelope 29 are sealed over the seal 57 to form the outer peripheral seal 39. The pump 33 is inserted into the handle and circumferentially sealed at 41 to form the completed racket. The inflated racket is diagrammatically shown in FIG. 10*a* with the inner seal 43 and the outer seals 57, 39.

In use, when a striking surface 45 is hit with a ball, it deflects inwardly and the inflatable inner element 27 transmits the increased tension to the other striking surface 45, which helps counteract deformation of the striking surface which is being struck.

To deflate the racket the cap 59 of the valve 35 is opened as shown in FIG. 10*b*.

We have found that an overpressure valve may not be needed with the squeeze pump 33, as the pump has an inherent limitation on how much pressure it can develop, which is less than the bursting strength of the vinyl. However, we contemplate that with the use of certain pumps, it may be desirable to add an overpressure valve; for example, in the handle 31.

A hand sheath (not shown) in the form of a glove or mitten, made of vinyl cloth or other flexible material into which the hand may be fitted, may be attached to the handle 31 of the racket. The hand sheath protects the player's hand from contact with the ball and aids his grip on the racket. The hand sheath may conveniently be cut as an integral part of the outer envelope 29.

It will thus be seen that the objects set forth above among those that are made apparent from the preceding description are efficiently attained and since certain changes may be made in the above articles without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A collapsible and inflatable racket comprising a head and handle portion, said head comprising an inflatable element having a hollow, inflatable, generally toroidal portion having an open area in the central portion thereof and fitted within an exterior envelope forming spaced apart ball striking surfaces covering said open area, and a permanently attached air pump integral and unitary with said racket, and wherein said inflatable element comprises an inflatable handle portion connected to said toroidal portion for inflation therewith, said handle having a base located away from said head portion said pump being located at the base of the handle portion such that said pump, when squeezed, forces air along and inflates the entire circumference of the racket including the head and handle portions of the racket.

2. A racket as defined in claim 1 and further comprising a manually operable valve for deflating said inflatable element.

3. A racket as defined in claim 2 wherein the space between said spaced apart ball striking surfaces is open to the atmosphere.

4. A racket as defined in claim 1 wherein said air pump is manually operable.

5. A racket as defined in claim 4 and further comprising a manually operable valve for deflating said inflatable element.

6. A racket as defined in claim 5 wherein the space between said ball striking surfaces is open to the atmosphere.

7. A racket as defined in claim 4 wherein the interior of said envelope covering the hole in said toroidal portion is open to the atmosphere.

8. A racket as defined in claim 1 or 4 wherein said pump forms at least part of the handle of said racket.

9. A racket as defined in claim 8 wherein said pump comprises an inlet valve and an outlet valve and a squeezable portion therebetween.

10. A racket as defined in claim 9 wherein said valves are butterfly valves.

11. A racket as defined in claim 9 wherein said valves are ball valves.

12. A racket as defined in claim 1 and further comprising a relief valve for preventing over inflation of said racket.

13. A racket as defined in claim 1 and further comprising a hand sheath attached to the handle of said racket.

14. A racket as defined in claim 1 wherein said racket is formed of flexible sheet material to provide for collapsing of said racket into a small space when it is not inflated.

15. A racket as defined in claim 1 formed of four pieces of sheet material, two first pieces being generally ankh shaped without a horizontal cross member and sealed together at their outer and inner peripheries to form said inflatable element and two second pieces conforming to the shape of the first two sheets and sealed together at their outer perheries to form said exterior envelope.

16. A racket as defined in claim 15 wherein said outer peripheries of said four pieces of sheet material are sealed together.

17. A racket as defined in claim 16 wherein at least one of said two second pieces of sheet material has an air pervious hole therein.

18. A racket has defined in claim 1 wherein the space between the spaced apart ball striking surfaces is open to the atmosphere.

* * * * *